US007029228B2

(12) United States Patent
Chan et al.

(10) Patent No.: US 7,029,228 B2
(45) Date of Patent: Apr. 18, 2006

(54) METHOD AND APPARATUS FOR CONVECTIVE COOLING OF SIDE-WALLS OF TURBINE NOZZLE SEGMENTS

(75) Inventors: Sze Bun Brian Chan, Greer, SC (US); John Ellington Greene, Greenville, SC (US); Linda Jean Farral, Greenville, SC (US)

(73) Assignee: General Electric Company, Schenecady, NY (US)

( * ) Notice: Subject to any disclaimer, the term of this patent is extended or adjusted under 35 U.S.C. 154(b) by 0 days.

(21) Appl. No.: 10/728,198

(22) Filed: Dec. 4, 2003

(65) Prior Publication Data

US 2005/0123388 A1 Jun. 9, 2005

(51) Int. Cl.
*F01D 25/12* (2006.01)

(52) U.S. Cl. ..... 415/1; 415/115; 415/139

(58) Field of Classification Search ..... 415/115, 415/191, 199.5, 139, 1
See application file for complete search history.

(56) References Cited

U.S. PATENT DOCUMENTS

| | | | | |
|---|---|---|---|---|
| 3,628,880 | A * | 12/1971 | Smuland et al. | 415/175 |
| 3,807,892 | A | 4/1974 | Frei et al. | |
| 5,116,199 | A | 5/1992 | Ciokajlo | |
| 5,197,852 | A * | 3/1993 | Walker et al. | 415/115 |
| 5,634,766 | A | 6/1997 | Cunha et al. | |
| 5,823,741 | A | 10/1998 | Predmore et al. | |
| 6,126,389 | A | 10/2000 | Burdgick | |
| 6,142,734 | A * | 11/2000 | Lee | 416/97 R |
| 6,419,445 | B1 | 7/2002 | Burdgick | |
| 2001/0005480 | A1 | 6/2001 | Yu et al. | |

FOREIGN PATENT DOCUMENTS

| | | |
|---|---|---|
| EP | 1327999 A2 | 5/2003 |
| GB | 1516757 | 10/1976 |
| GB | 2280935 | 2/1995 |
| JP | 6010388 | 1/1994 |

OTHER PUBLICATIONS

Novelty search report issued from the GB Patent Office (4 pgs.); International Application of: General Electric Company; GB Patent App. No.: GB0426389.
Novelty search report issued from the GB Patent Office (4 pgs.); International Application of: Cooper Technologies; GB Patent App. No.: 0426389.3; Filing date Dec. 1, 2004.

* cited by examiner

*Primary Examiner*—Ninh H. Nguyen
(74) *Attorney, Agent, or Firm*—Armstrong Teasdale LLP

(57) ABSTRACT

A turbine nozzle includes, in an exemplary embodiment, an outer band portion, an inner band portion at least one nozzle vane extending between the inner band portion and the outer band portion, and at least one cooling channel extending axially at least partially through at least one of the outer band portion and the inner band portion. The at least one nozzle vane, the inner band portion, and the outer band portion define a flowpath for flowing hot gases of combustion. Each cooling channel includes at least one inlet with each inlet isolated from the flowing hot gases of combustion.

21 Claims, 6 Drawing Sheets

METHOD AND APPARATUS FOR CONVECTIVE COOLING OF SIDE-WALLS OF TURBINE NOZZLE SEGMENTS

BACKGROUND OF THE INVENTION

This invention relates generally to turbines, and more particularly to convective cooling of mating areas of side walls between the seal slots and hot gas paths of turbine nozzle segments.

In at least some known industrial turbines, one or more of the nozzle stages are cooled by passing a cooling medium through a plenum in each nozzle segment portion forming part of the outer band and through one or more nozzle vanes to cool the nozzles, and into a plenum in a corresponding inner band portion. In some nozzle segments, the cooling medium then flows through the inner band portion and again through the one or more nozzle vanes prior to being discharged. In other nozzle segments, the cooling medium flows only once through each nozzle segment. Each of the nozzle segments includes inner and outer band portions and one or more nozzle vanes, and are typically cast.

The mating surfaces of the band portions include seal slots to accommodate seals that extend between adjacent band portions. Impingement air used to cool part of the band portions does not reach the area between the seal slots and the hot gases because of the seal slots. High metal temperatures can then develop in this area which can cause metal erosion and crack development due to high thermal stresses. In some known turbine nozzles, cooling holes feed cooling air from the turbine vane cavity to the mating faces. However, such an arrangement requires a significant increase of cooling flow and reduces turbine efficiency and results in increased heat rate.

BRIEF DESCRIPTION OF THE INVENTION

In one aspect, a turbine nozzle segment is provided. The gas turbine nozzle includes an outer band portion, an inner band portion, at least one nozzle vane extending between the inner band portion and the outer band portion, and at least one cooling channel extending axially at least partially through at least one of the outer band portion and the inner band portion. The at least one nozzle vane, the inner band portion, and the outer band portion define a flowpath for flowing hot gases. Each cooling channel includes at least one inlet with each inlet isolated from the flowing hot gases of combustion.

In another aspect a turbine nozzle segment is provided that includes an outer band portion having an outer surface, an inner surface, and first and second mating side surfaces, an inner band portion having an outer surface, an inner surface, and first and second mating side surfaces, at least one nozzle vane extending between the outer surface of the inner band portion and the inner surface of the outer band portion, and at least one cooling channel extending axially at least partially through at least one of the outer band portion and the inner band portion. The at least one nozzle vane, the outer surface of the inner band portion, and the inner surface of the outer band portion define a flowpath for flowing hot gases of combustion. Each cooling channel includes at least one inlet with each inlet isolated from the flowing hot gases of combustion.

In another aspect, a method of cooling mating side faces of inner and outer band portions of gas turbine nozzle segments is provided. The nozzle segment includes an outer band portion, an inner band portion, and at least one nozzle vane extending between the inner band portion and the outer band portion. The at least one nozzle vane, the inner band portion, and the outer band portion define a flowpath for flowing hot gases of combustion. The method includes flowing a cooling medium through at least one cooling channel extending axially at least partially through at least one of the outer band portion and the inner band portion. Each cooling channel includes at least one inlet with each inlet isolated from the flowing hot gases of combustion.

In another aspect, a gas turbine apparatus is provided. The gas turbine includes a plurality of nozzle stages that include a plurality of nozzle segments. Each nozzle segment includes an outer band portion, an inner band portion, at least one nozzle vane extending between the inner band portion and the outer band portion, and at least one cooling channel extending axially at least partially through at least one of the outer band portion and the inner band portion. The at least one nozzle vane, the inner band portion, and the outer band portion define a flowpath for flowing hot gases. Each cooling channel includes at least one inlet with each inlet isolated from the flowing hot gases of combustion.

DETAILED DESCRIPTION OF THE INVENTION

Turbine nozzles in which the mating faces of the band segments between the seal slots and the hot gas path are convectively cooled by flowing air parallel to the mating faces within the nozzle band segments are described in detail below. In known turbine nozzles, impingement cooling does not reach the area between the seal slots and the hot gases because of the seal slots. High metal temperatures can then develop in this area which can cause metal erosion and crack development due to high thermal stresses. In some known turbine nozzles, cooling holes feed cooling air from the turbine vane cavity to the mating faces. However, such an arrangement requires a significant increase of cooling flow and reduces turbine efficiency and results in increased heat rate. The turbine nozzles described below use a lower temperature air, for example, compressor discharge air or aft impingement air from an upstream impingement region to feed a cooling channel extending parallel to the mating surface through the upper and/or lower band portion of the nozzle to convectively cool the mating faces of the band segments between the seal slots and the hot gas path.

Figure 1:
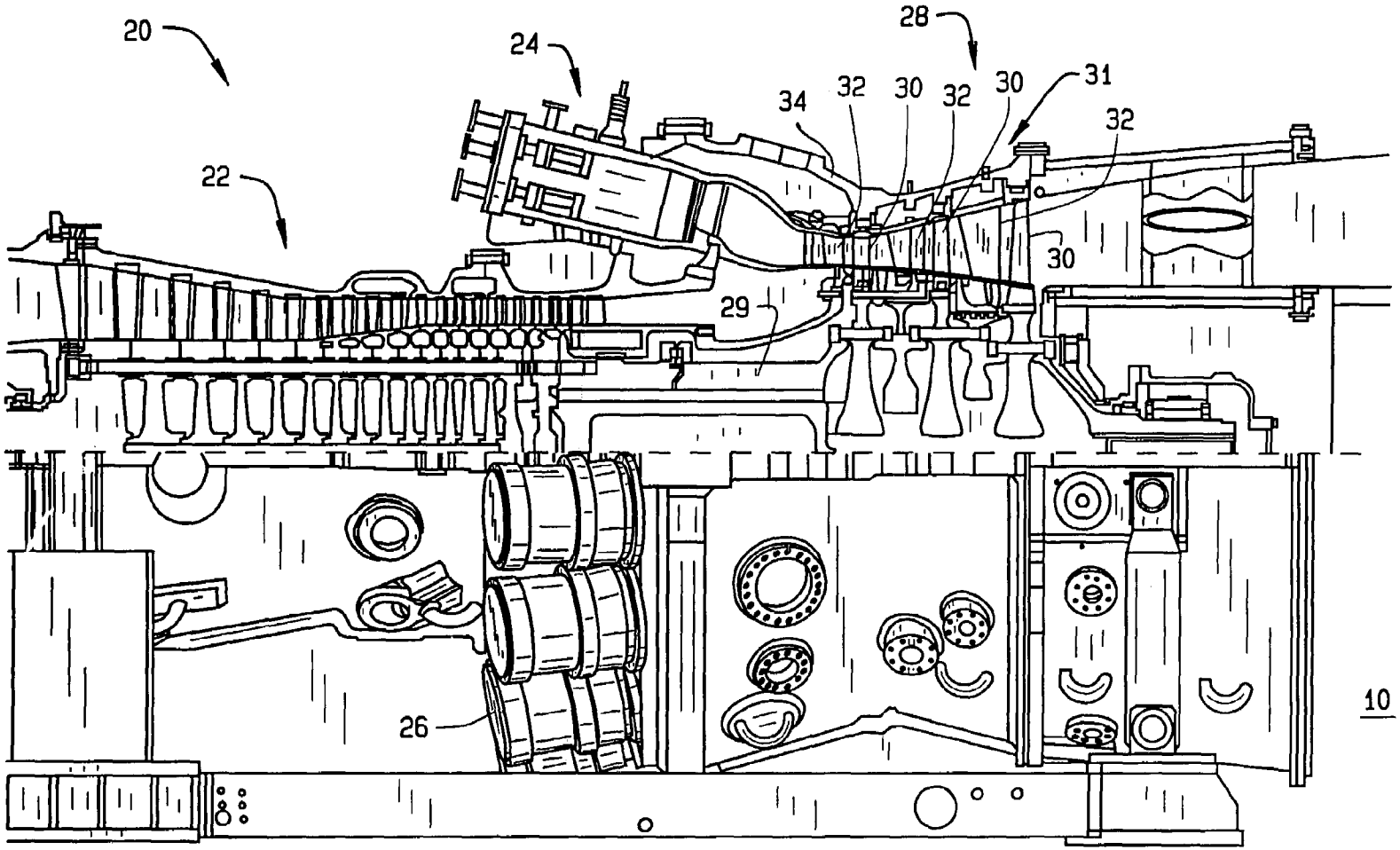
FIG. 1 is a side cutaway view of a gas turbine system that includes a gas turbine

Referring to the drawings, FIG. 1 is a side cutaway view of a gas turbine system 10 that includes a gas turbine 20. Gas turbine 20 includes a compressor section 22, a combustor section 24 including a plurality of combustor cans 26, and a turbine section 28 coupled to compressor section 22 using a shaft 29. A plurality of turbine blades 30 are connected to turbine shaft 29. Between turbine blades 30 there is positioned a plurality of nonrotating turbine nozzle stages 31 that include a plurality of turbine nozzles 32. Turbine nozzles 32 are connected to a housing or shell 34 surrounding turbine blades 30 and nozzles 32. Hot gases are directed through nozzles 32 to impact blades 30 causing blades 30 to rotate along with turbine shaft 29.

In operation, ambient air is channeled into compressor section 22 where the ambient air is compressed to a pressure greater than the ambient air. The compressed air is then channeled into combustor section 24 where the compressed air and a fuel are combined to produce a relatively high-pressure, high-velocity gas. Turbine section 28 is configured to extract and the energy from the high-pressure, high-velocity gas flowing from combustor section 24. The combusted fuel mixture produces a desired form of energy, such as, for example, electrical, heat and mechanical energy. In one embodiment, the combusted fuel mixture produces electrical energy measured in kilowatt-hours (kWh). However, the present invention is not limited to the production of electrical energy and encompasses other forms of energy, such as, mechanical work and heat. Gas turbine system 10 is typically controlled, via various control parameters, from an automated and/or electronic control system (not shown) that is attached to gas turbine system 10.

Figure 2:
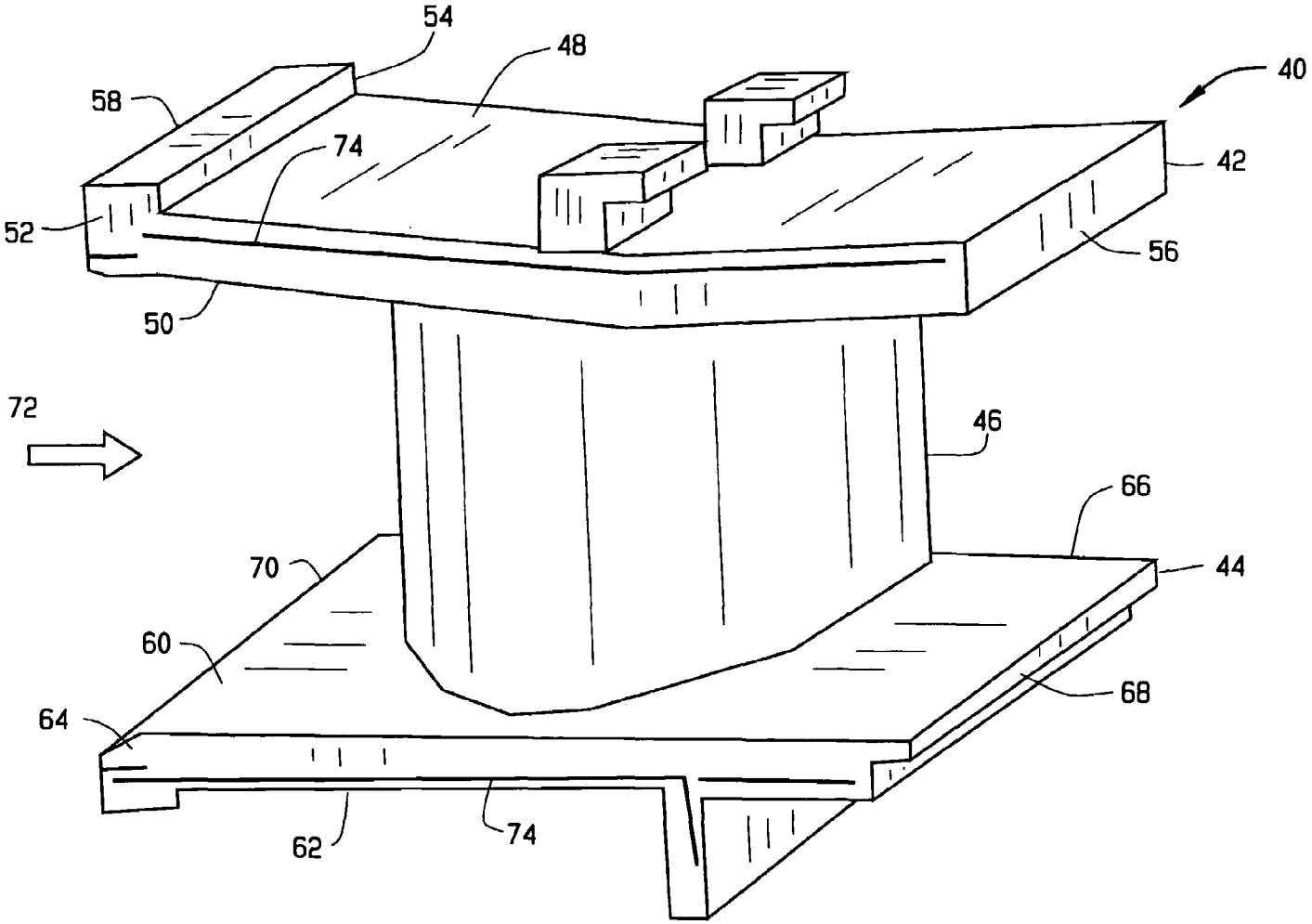
FIG. 2 is perspective schematic illustration of a turbine nozzle segment shown in FIG. 1.
Figure 3:
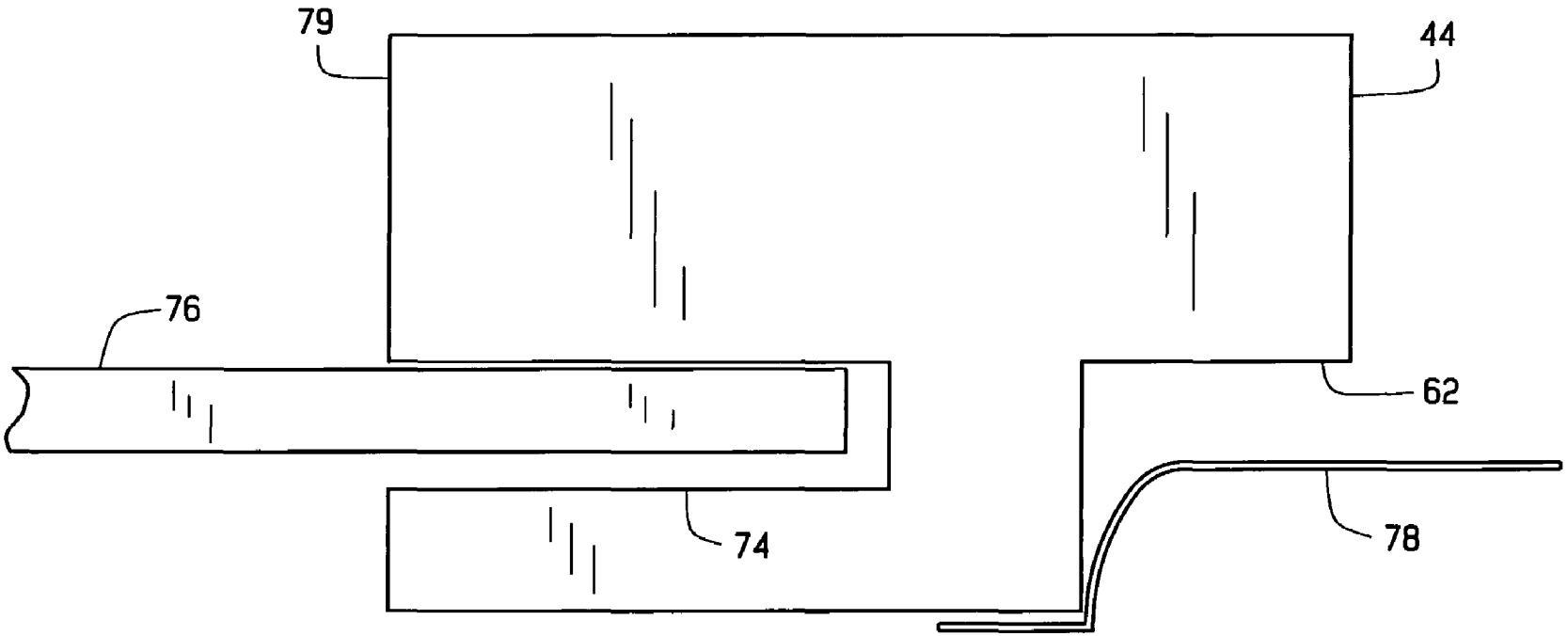
FIG. 3 is a sectional schematic illustration of the inner band portion of the turbine nozzle segment shown in FIG. 2.

FIG. 2 is a perspective schematic illustration of a turbine nozzle segment 40 and FIG. 3 is a sectional schematic illustration of turbine nozzle segment 40. Referring to FIGS. 2 and 3, nozzle segment 40, in an exemplary embodiment, includes an outer band portion 42, an inner band portion 44, and a nozzle vane 46 extending between inner and outer band portions 42 and 44. In alternate embodiments, nozzle segment includes a plurality of nozzle vanes 46. A plurality of nozzle segments 40 are arranged circumferentially about the axis of the turbine and secured to the turbine shell to form a nozzle stage.

Outer band portion 42 includes an outer surface 48, an inner surface 50, first and second mating side surfaces 52 and 54, a down stream edge 56 and an upstream edge 58. Inner band portion 44 includes an outer surface 60, an inner surface 62, first and second mating side surfaces 64 and 66, a down stream edge 68 and an upstream edge 70. Nozzle vane 46 extends between inner surface 50 of outer band portion 42 and outer surface 60 of inner band portion 44. A flow path 72 for hot gases of combustion is defined by nozzle vane 46 and inner surface 50 of outer band portion 42 and outer surface 60 of inner band portion 44. The hot gases flow through flow path 72 and engage the rotor buckets 30 (shown in FIG. 1) of the turbine to rotate the rotor.

Mating surfaces 52, 54, 64, and 66 include seal slots 74 which extend circumferentially into the mating surfaces. Seal slots 74 are sized to receive seals 76. Seals 76 prevent cooling air from leaking into flow path 72. As shown in FIG. 3, an impingement plate 78 is located adjacent inner surface 62 of inner band portion 44. Impingement cooling air passes through impingement plate 78 to cool inner surface 62. Because of the location of seal slots 74, impingement cooling air cannot be used to cool a portion 79 of mating surfaces 52, 54, 64, and 66 that is between seal slot 74 and hot gas flow path 72.

Figure 4:
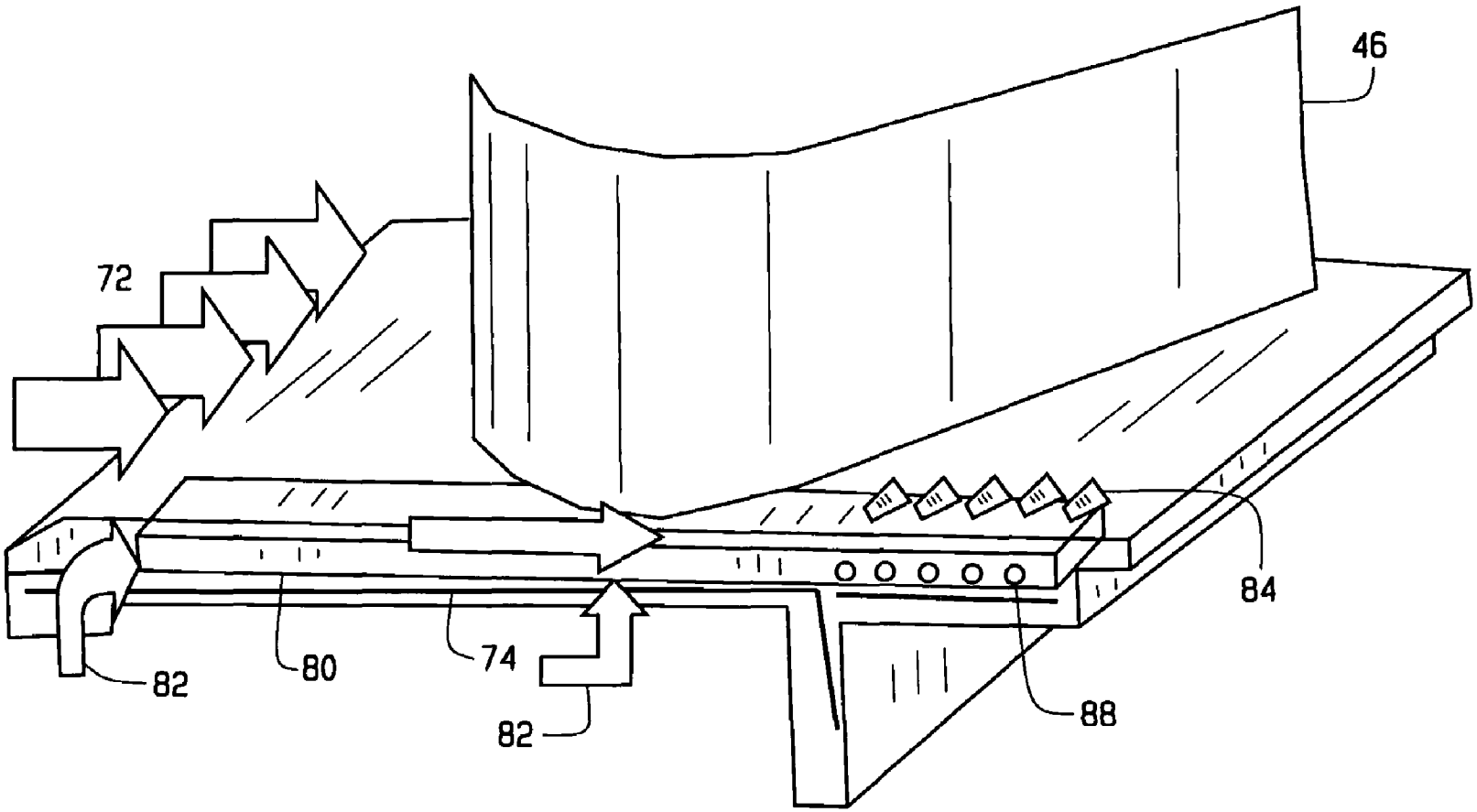
FIG. 4 is a perspective schematic illustration, with parts cut away, of a turbine nozzle segment in accordance with an embodiment of the present invention.
Figure 5:
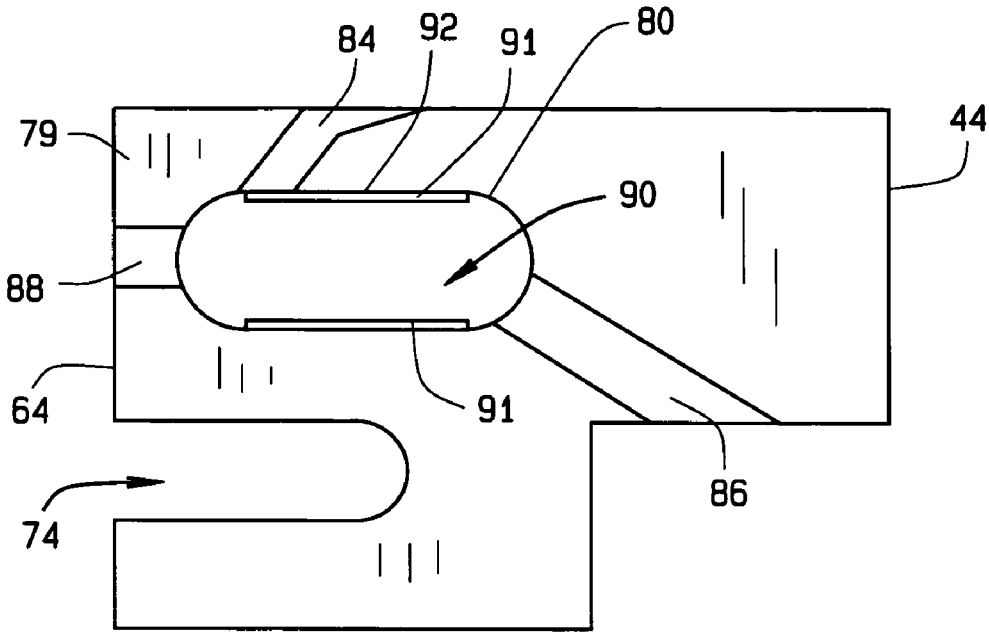
FIG. 5 is a sectional schematic illustration of the inner band portion of the nozzle segment shown in FIG. 4.
Figure 6:
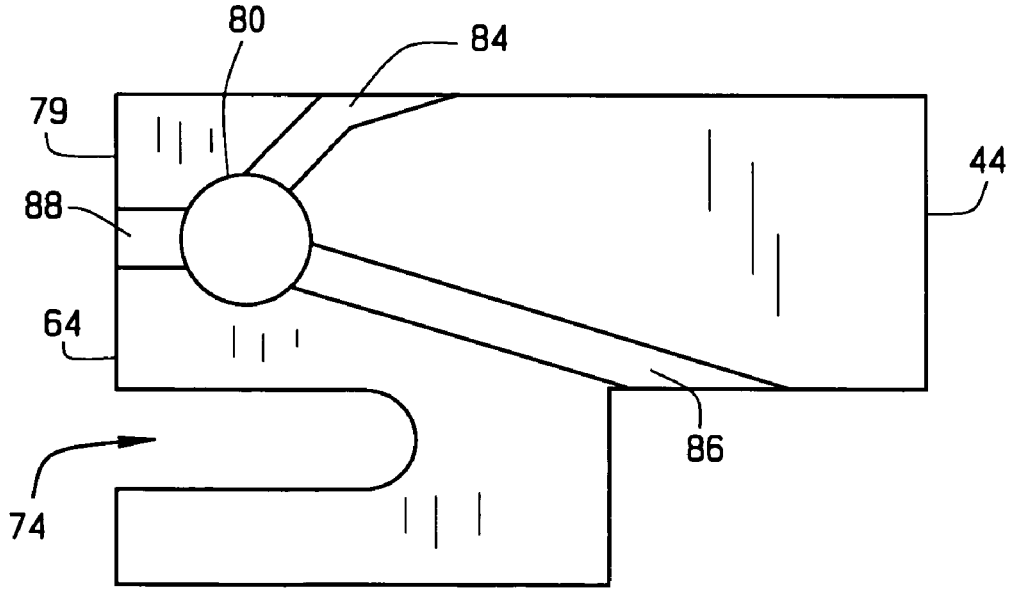
FIG. 6 is a sectional schematic illustration of the inner band portion of a turbine nozzle segment in accordance with another embodiment of the present invention.

Referring also to FIGS. 4–6, to cool portion 79 of mating surfaces 52, 54, 64, and 66, a convective cooling channel 80 extends axially through outer band portion 42 and/or inner band portion 44 and parallel to mating surfaces 52, 54, 64, and 66. Convective cooling channel 80 is located between seal slot 74 and hot gas flow path 72. Cooling channel 80 includes at least one inlet port 82 (two shown). Each inlet 82 of cooling channel 80 is isolated from hot gas flow path 72 so that the hot gases do not enter cooling channel 80. Inlets 82 permit lower temperature air to enter and flow through cooling channel 80 to provide convective cooling to the metal adjacent cooling channel 80, including portion 79 of the mating surface. The lower temperature air can be compressor discharge air and/or aft-impingement air from an upstream impingement area. At least one exit port permits the cooling air to exit cooling channel 80. An exit port 84 opens to hot gas flow path 72 to permit spent cooling air to discharge into flow path 72. An exit port 86 opens to a down stream impingement area to permit spent cooling air to be used as downstream impingement cooling air. An exit port 88 permits spent cooling air to discharge to mating face area to be used for purging segment mating area of hot gas flow. The exemplary embodiment shown in FIG. 5 includes exit ports 84, 86, and 88. However, in alternate embodiments, cooling channel 80 can include any only one of, or any combination of exit ports 84, 86, and 88. Further, in alternate embodiments, cooling channel 80 can include one or more of each type of exit port 84, 86, and 88.

Figure 7:
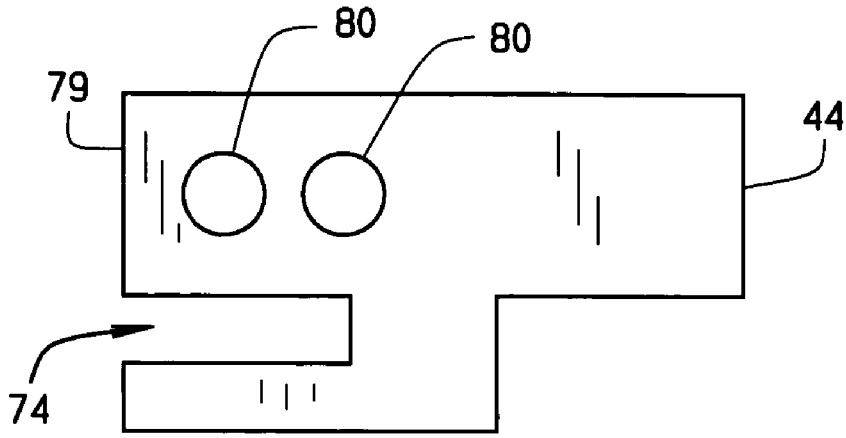
FIG. 7 is a sectional schematic illustration of the inner band portion of a turbine nozzle segment in accordance with another embodiment of the present invention.

In FIG. 5, cooling channel 80 is shown as having an oblong cross section. However, in an alternate embodiment shown in FIG. 6, cooling channel 80 can have a circular cross section, and in another alternate embodiment shown in FIG. 7, there are two parallel cooling channels 80. Further, as shown in FIG. 5 turbulators 90 extend into cooling channel 80 to promote turbulent flow which increases cooling effectiveness. In the exemplary embodiment, turbulator 90 include ribs 91 extending from inner surface 92 of cooling channel 80 that are arranged to be between about 45 degrees to about 90 degrees to the flow of cooling air through channel 80. In alternate embodiments, turbulators 90 include any suitable obstruction inside cooling channel 80 that promotes turbulent flow through channel 80.

Figure 8:
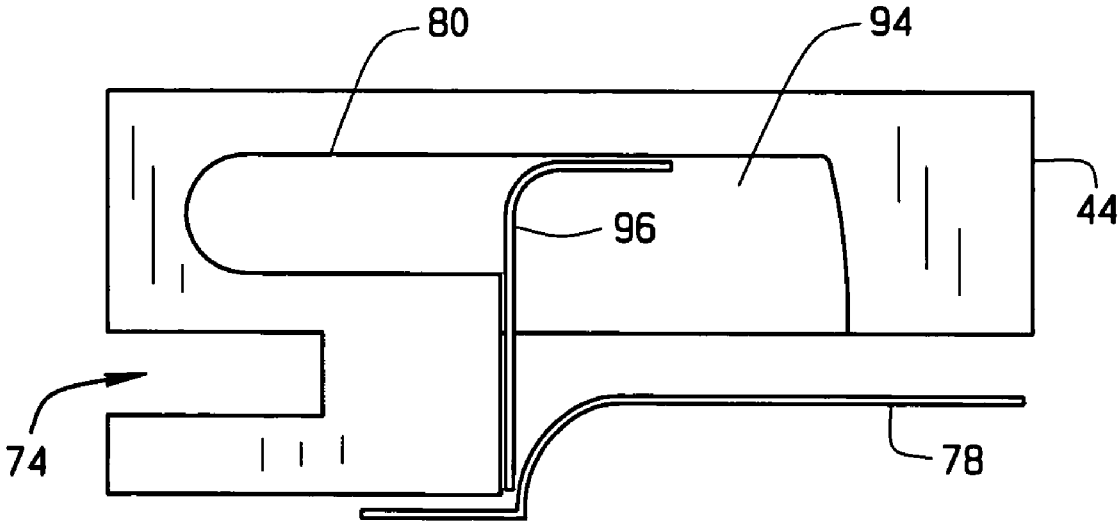
FIG. 8 is a sectional schematic illustration of the inner band portion of a turbine nozzle segment in accordance with another embodiment of the present invention.

Cooling channel 80 can be cast or machined as an internal cavity in inner band portion 44 or outer band portion 42. Also, in an alternate embodiment illustrated in FIG. 8, cooling channel 80 can be formed by covering an undercut region 94 in band portion 44 between seal slot 74 and hot gas flow path 72 with a metal plate 96. Particularly, metal plate 96 seals off a portion of undercut region 94 thus forming cooling channel 80.

The above described turbine nozzle segment 40 uses convective cooling by passing cooling air through cooling channel 80 to cool the mating faces in the area between seal slots 74 and hot gases flow path 72. Compressor discharge air and/or aft impingement air from an upstream impingement region is used to feed cooling channel 80 without increasing the required cooling air through the turbine. The convective cooling reduces metal temperature which reduces crack development due to high thermal stresses.

While the invention has been described in terms of various specific embodiments, those skilled in the art will recognize that the invention can be practiced with modification within the spirit and scope of the claims.

What is claimed is:

1. A turbine nozzle segment comprising:

an outer band portion;

an inner band portion;

at least one nozzle vane extending between said inner band portion and said outer band portion, said at least one nozzle vane, said inner band portion, and said outer band portion defining a flowpath for flowing hot gases of combustion; and at least one cooling channel extending axially at least partially through at least one of said outer band portion and said inner band portion, such that said at least one cooling channel is defined by an undercut region in said band portion and a coverplate covering at least a portion of said undercut region of said band portion, each said cooling channel comprising at least one inlet, each said inlet isolated from the flowing hot gases of combustion.

2. A turbine nozzle segment in accordance with claim 1 wherein inner and outer band portions each comprise first and second mating side surfaces, each said mating side surface comprising a seal slot extending circumferentially into said mating surface, said at least one cooling channel located between said seal slot and said hot gas flowpath.

3. A turbine nozzle segment in accordance with claim 2 wherein each said inlet is located in an upstream end portion of said cooling channel and is in communication with at least one of compressor discharge air and impingement cooling air from an upstream nozzle segment.

4. A turbine nozzle segment in accordance with claim 2 wherein a downstream end portion of each said cooling channel comprising at least one exit port.

5. A turbine nozzle segment in accordance with claim 4 wherein each said exit port is in communication with at least one of said hot gas flow path, a mating side surface of said band portion, and a downstream cooling impingement area.

6. A turbine nozzle segment comprising:

an outer band portion having an outer surface, an inner surface, and first and second mating side surfaces;

an inner band portion having an outer surface, an inner surface, and first and second mating side surfaces;

at least one nozzle vane extending between said outer surface of said inner band portion and said inner surface of said outer band portion, said at least one nozzle vane, said outer surface of said inner band portion, and said inner surface of said outer band portion defining a flowpath for flowing hot gases of combustion; and at least one cooling channel extending axially at least partially through at least one of said outer band portion and said inner band portion, such that said at least one cooling channel is defined by an undercut region in said band portion and a cover plate covering at least a portion of said undercut region of said band portion, each said cooling channel comprising at least one inlet, each said inlet isolated from the flowing hot gases of combustion.

7. A turbine nozzle segment in accordance with claim 6 wherein said first and second mating side surfaces of said inner and said outer band portions comprising a seal slot extending circumferentially into said mating surfaces, at least one cooling channel located between at least one of said seal slot and said outer surface of said inner band portion, and said seal slot and said inner surface of said outer band portion.

8. A turbine nozzle segment in accordance with claim 7 wherein each said inlet is located in an upstream end portion of said cooling channel and is in communication with at least one of compressor discharge air and impingement cooling air from an upstream nozzle segment.

9. A turbine nozzle segment in accordance with claim 7 wherein a downstream end portion of each said cooling channel comprising at least one exit port.

10. A turbine nozzle segment in accordance with claim 9 wherein each said exit port is in communication with at least one of said hot gas flow path, a mating side surface of said band portion, and a downstream cooling impingement area.

11. A turbine nozzle segment in accordance with claim 6 wherein said at least one cooling channel comprises a turbulator to promote turbulent air flow through said cooling channel.

12. A method of cooling mating side faces of inner and outer band portions of turbine nozzle segments, the nozzle segment comprising an outer band portion, an inner band portion, and at least one nozzle vane extending between the inner band portion and the outer band portion, the at least one nozzle vane, the inner band portion, and the outer band portion defining a flowpath for flowing hot gases of combustion, wherein the inner and outer band portions each comprise first and second mating side surfaces, each mating side surface comprises a seal slot extending circumferentially into the mating surface, and wherein the at least one cooling channel is located between the seal slot and said hot gas flowpath, said method comprising:

flowing a cooling medium through at least one cooling channel extending axially at least partially through at least one of the outer band portion and the inner band portion, each cooling channel comprising at least one inlet, each inlet isolated from the flowing hot gases of combustion.

13. A method in accordance with claim 12 wherein each said inlet is located in an upstream end portion of said cooling channel, said flowing a cooling medium through at least one cooling channel comprises flowing at least one of compressor discharge air and impingement cooling air from an upstream nozzle segment through the at least one cooling channel.

14. A method in accordance with claim 12 wherein a downstream end portion of each said cooling channel comprising at least one exit port.

15. A method in accordance with claim 14 wherein flowing a cooling medium through at least one cooling channel further comprises discharging the cooling medium from the at least one exit port into at least one of the hot gas flow path, a mating side surface of the band portion, and a downstream cooling impingement area.

16. A method in accordance with claim 12 wherein the cooling channel is defined by an undercut region in the band portion and a cover plate covering at least a portion of the undercut region of the band portion.

17. A gas turbine comprising a plurality of nozzle stages, each said nozzle stage comprising a plurality of nozzle segments, each said nozzle segment comprising:

an outer band portion;

an inner band portion;

at least one nozzle vane extending between said inner band portion and said outer band portion, said at least one nozzle vane, said inner band portion, and said outer band portion defining a flowpath for flowing hot gases of combustion; and at least one cooling channel extending axially at least partially through at least one of said outer band portion and said inner band portion, such that said at least one cooling channel is defined by an undercut region in said band portion and a cover plate covering at least a portion of said undercut region of said band portion, each said cooling channel comprising at least one inlet, each said inlet isolated from the flowing hot gases of combustion.

18. A gas turbine in accordance with claim 17 wherein said inner and outer band portions each comprise first and second mating side surfaces, each said mating side surface comprising a seal slot extending circumferentially into said mating surface, said at least one cooling channel located between said seal slot and said hot gas flowpath.

19. A gas turbine in accordance with claim 18 wherein each said inlet is located in an upstream end portion of said cooling channel and is in communication with at least one of compressor discharge air and impingement cooling air from an upstream nozzle segment.

20. A gas turbine in accordance with claim 18 wherein a downstream end portion of each said cooling channel comprising at least one exit port.

21. A gas turbine in accordance with claim 20 wherein each said exit port is in communication with at least one of said hot gas flow path, a mating side surface of said band portion, and a downstream cooling impingement area.

* * * * *